US008235260B2

(12) United States Patent
Phan

(10) Patent No.: US 8,235,260 B2
(45) Date of Patent: Aug. 7, 2012

(54) GARMENT WASHING DEVICE FOR PLUS SIZE BRASSIERES

(76) Inventor: Kieu Thi-Bich Phan, Houston, TX (US)

( * ) Notice: Subject to any disclaimer, the term of this patent is extended or adjusted under 35 U.S.C. 154(b) by 418 days.

(21) Appl. No.: 12/394,861

(22) Filed: Feb. 27, 2009

(65) Prior Publication Data

US 2010/0219213 A1 Sep. 2, 2010

(51) Int. Cl.
*D06C 15/00* (2006.01)

(52) U.S. Cl. ..... 223/84; 223/66; 223/1

(58) Field of Classification Search ..... 223/1, 66, 223/57, 84; 206/278, 292; 99/323
See application file for complete search history.

(56) References Cited

U.S. PATENT DOCUMENTS

| | | | | | |
|---|---|---|---|---|---|
| 2,471,007 | A * | 5/1949 | Pasznicki | 223/88 |
| 2,951,621 | A * | 9/1960 | Cheney | 223/66 |
| 3,085,723 | A * | 4/1963 | Vanderburg | 223/66 |
| 3,837,476 | A * | 9/1974 | Schwartz | 206/45.24 |
| 4,345,512 | A * | 8/1982 | Moore | 99/323 |
| 5,556,013 | A * | 9/1996 | Mayer | 223/84 |
| 5,829,083 | A | 11/1998 | Sutton | |
| 5,865,333 | A * | 2/1999 | Wolfe | 220/4.21 |
| 5,971,236 | A * | 10/1999 | DesForges et al. | 223/84 |
| 6,234,368 | B1 * | 5/2001 | DesForges et al. | 223/84 |
| 6,510,972 | B1 * | 1/2003 | Briskey | 223/24 |
| 6,742,683 | B1 | 6/2004 | Phan | |
| D524,500 | S | 7/2006 | Wai | |
| 7,350,679 | B2 * | 4/2008 | Radtke et al. | 223/84 |
| 7,922,046 | B2 * | 4/2011 | Radtke et al. | 223/84 |
| 2007/0241103 | A1 * | 10/2007 | Kaylor | 220/4.22 |
| 2009/0078725 | A1 * | 3/2009 | Phan | 223/84 |

OTHER PUBLICATIONS

PCT International Preliminary Report, Mar. 24, 2010.

* cited by examiner

*Primary Examiner* — Shaun R Hurley
*Assistant Examiner* — Andrew Sutton
(74) *Attorney, Agent, or Firm* — Cook Alex Ltd.

(57) ABSTRACT

A washing device for plus size bras includes a shell which consists of upper and lower shell portions. The upper and shell portions are curved inwardly and may have flat upper and lower surfaces, respectively, such that the height of the shell is less than the lateral dimension of the shell between opposite sides. A hinge permits opening of the upper shell portion with respect to the lower shell portion to insert a bra into the washing device, and a releasable latch mechanism securely holds the upper shell portion and a lower shell portion together during a washing cycle. Preferably, the height of the washing device is about one-half, or less, of the lateral dimension of the washing device, thereby permitting easy insertion into the washing machine.

18 Claims, 9 Drawing Sheets

GARMENT WASHING DEVICE FOR PLUS SIZE BRASSIERES

FIELD OF THE INVENTION

The present invention relates generally to devices for washing brassieres, and, more particularly, to devices for washing plus size brassieres and the like.

BACKGROUND OF THE INVENTION

Brassieres (also commonly called "bras") are commonly made with two cups, two shoulder straps, two back straps, a latching mechanism (hooks and eyelets), optional padding (soft foam, air, water, gel, or silicone), and, optionally, two under-wires. Padding can come as removable inserts or as an integral part of the bra. Some bras comprise extremely delicate fabric, such as lace, satin, silk, mesh, high-tech microfiber, stretch, and sheer fabric.

The under-wires, when used in the cups, often become misshapen during washing and drying. Over time, the under-wires can also tear through the bra's fabric. This can result in injury to the breast or bra, and can also damage other clothing and the washing machine drum.

The latching mechanism, located either on the two back straps or on the front in between the cups at the inter-cup bridge, typically has a couple to several hooks and eyelets or a plastic snap closure. In the washing machine and/or dryer the hooks frequently snag onto the bra itself, zippers, buttonholes, sweaters, and delicate fabrics, as well as becoming misshapen. A bra can also easily become tangled with other clothing and in crevices within the washer and dryer, causing further deformities to the cups, padding, under-wires, fabric, and straps. Repeated machine washing and drying can also substantially diminish the elasticity of bras. The padding, especially if made of thick and soft foam, often becomes indented and bunched. If made of air, water, gel, or silicone, it can become punctured and leak. Such deformities are visible, even through a T-shirt, and are especially noticeable when tight fitting garments are worn. These problems are well understood by women who wear padded or non-padded bras.

Another way to wash bras is to place it within a mesh washing bag, which is then placed in a washing machine. However, because of its soft material construction, the bag still does not adequately prevent the bra from being damaged—such as losing its original shape, collapsing inward and against the cups' curved shape, and becoming tangled with other bras or clothing within the same bag. In addition, padded bras (especially those using air, water, gel, or silicone) can be easily punctured, thus causing leakage to the bra cups. The time and money needed to replace a damaged bra can also be substantial.

Given all these inconveniences, many women have chosen to wash their bras by hand. However, hand-washing is very time-consuming and impractical. It can also induce back, hand, and wrist pain. Most bras that are hand-washed have to be air-dried, which causes water deposits where they are hung and thus slippery surfaces and more unnecessary cleanup.

The present inventor has previously been issued U.S. Pat. No. 6,742,683 (the '683 patent) on Jun. 1, 2004, which is entitled "Washing, Drying, and Storage Device for Brassieres and Bikini Tops". The device disclosed in this patent is generally spherical in shape. It is entirely adequate for laundering of petite, small, regular and large size bras. For example, petite size bras are commonly marketed in the United States as size 32, small size bras as size 34, regular size bras as size 36 and large size bras as size 38. Other countries may use corresponding metric sizes. Depending upon the size and shape of the cups of the bra, the device disclosed in '683 patent may also be suitable for laundering of bras of larger size than size 38.

As used herein, "plus size" with respect to bras will generally mean size 40 or larger, such as size 42, size 44, size 46, size 48, and so forth. Such plus size bras typically do not fit into the washing device of the '683 patent, especially those bras over size 40 or 42.

Furthermore, making a larger generally spherical washing device to accommodate the plus size bras is possible, but not practical since it will not fit into most top-loading washing machines. That is, the spacing between the top of the agitator and the top edge of the drum of the washing machine is not large enough to accommodate a larger generally spherical washing device similar to that shown in the '683 patent. Thus, such a larger laundry device cannot be properly inserted into the washing machine.

A general object of the present invention is to therefore provide a washing device which will accommodate plus size bras and still be of a size or configuration which permits the washing device to be easily inserted into a washing machine.

Another object of the present invention is to provide a washing device for plus size bras which is of sturdy construction to withstand the agitation typically encountered in a washing machine.

SUMMARY OF THE INVENTION

The present invention is directed to a washing device for washing plus size bras. In accordance with one embodiment, the washing device includes a shell with an interior, the shell consisting of an upper shell portion and a lower shell portion, the upper shell portion and the lower shell portion are curved inwardly toward an internal center of the washing device. For example, the upper and lower shell portions may have relatively flat upper and lower surfaces, respectively, such that the height of the shell is less than the lateral dimension of the shell between opposite sides, a hinge disposed along one side of the upper shell portion and the lower shell portion, the hinge permitting opening of the upper shell portion with respect to the lower shell portion to insert a bra into the interior of the washing device, and a releasable latch mechanism to securely hold the upper shell portion and a lower shell portion together during a washing cycle. The height of the washing device is preferably about one-half, or less, of the lateral dimension of the washing device, such that the washing device may be easily inserted into the washing machine. The shell may include a generally flat rear surface and generally curved side and front surfaces.

In accordance with another embodiment, the washing device preferably includes an insert which is kept in a substantially fixed relationship to the shell when inserted therein. The insert may couple to the shell in a tab and slot arrangement. The insert may have a rounded portion to generally conform to the shape of a bra cup. Alternatively, at least a portion of the insert is substantially flat. A plurality of arms extends between the tabs and the rounded portion or the flat portion of the insert. The insert may have a pocket configured to receive at least one bra strap, and it may be configured to divide the interior of the shell into two spatial regions, and a passage connects the two spatial regions.

In accordance with a still further embodiment, the latch mechanism preferably includes a tongue and a loop on one portion of the shell, and a receptacle on the other portion of the shell, the receptacle configured to receive the tongue and the loop. The receptacle may further include a rail configured to contact the loop, and contact between the loop and rail preferably inhibit the latch mechanism from opening accidentally during washing. For example, the latch mechanism may include a resilient member on one shell portion, with the resilient member disposed between a pair of slots, and the slots do not overlap with the other shell portion when the latch mechanism is closed. The latch mechanism may be operated by simultaneously applying a force in an inward direction and a force in an upward direction.

In accordance with yet another embodiment, preferably, at least one of the shell portions includes a rim, and at least one of the shell portions includes a channel, such that a lip on one of the shell portions couples in the channel in the other shell portion when the shell is closed for improved durability of the washing device while being subjected to the agitation of a washing cycle in a washing machine.

The shell of the washing device preferably includes a plurality of openings, the openings being sized to inhibit a bra strap from extending out of the shell through the openings. The insert may also include a plurality of openings, and at least some of the openings in the insert are larger than the openings in the shell.

BRIEF DESCRIPTION OF THE DRAWINGS

The invention, together with its objects and the advantages thereof, may best be understood by reference to the following description taken in conjunction with the accompanying drawings, in which like reference numerals identify like elements in the figures, and in which.

DESCRIPTION OF THE PREFERRED EMBODIMENTS

It will be understood that the present invention may be embodied in other specific forms without departing from the spirit thereof. The present examples and embodiments, therefore, are to be considered in all respects as illustrative and not restrictive, and the invention is not to be limited to the details presented herein.

Figure 1:
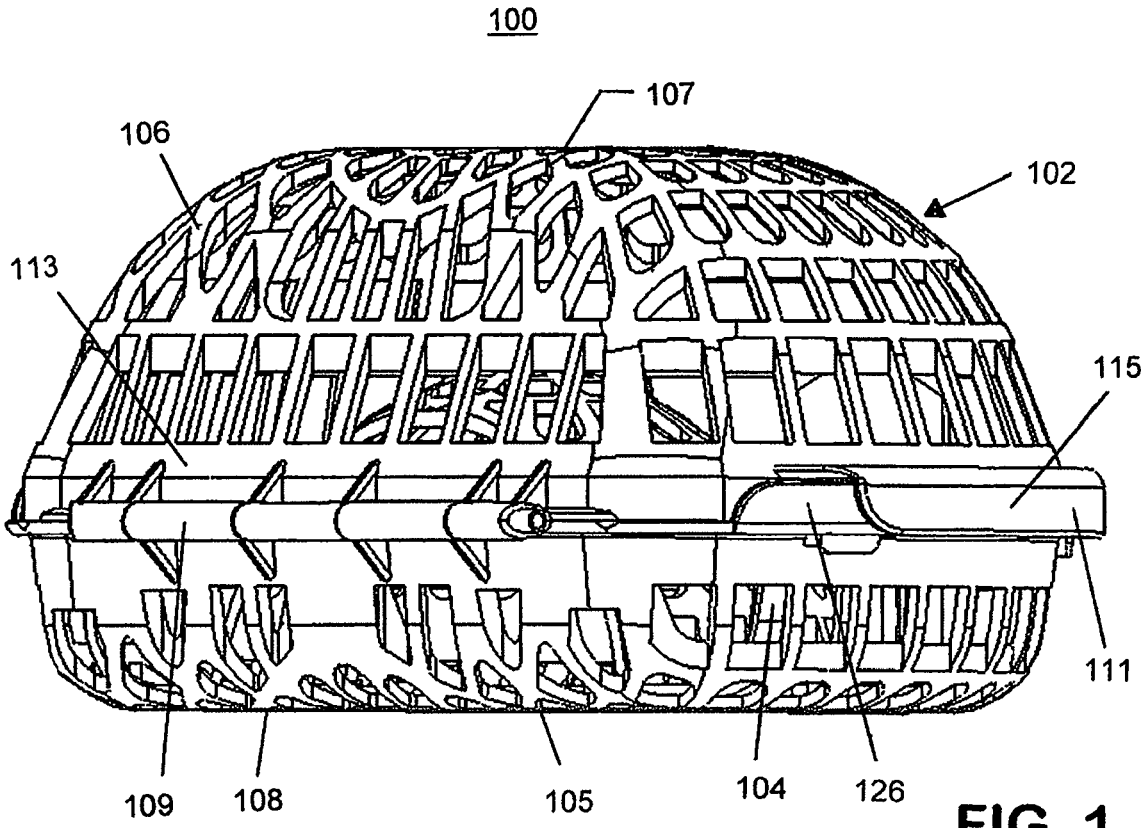
FIG. 1 is a rear and side elevational view of a washing device in accordance with the present invention.
Figure 2:
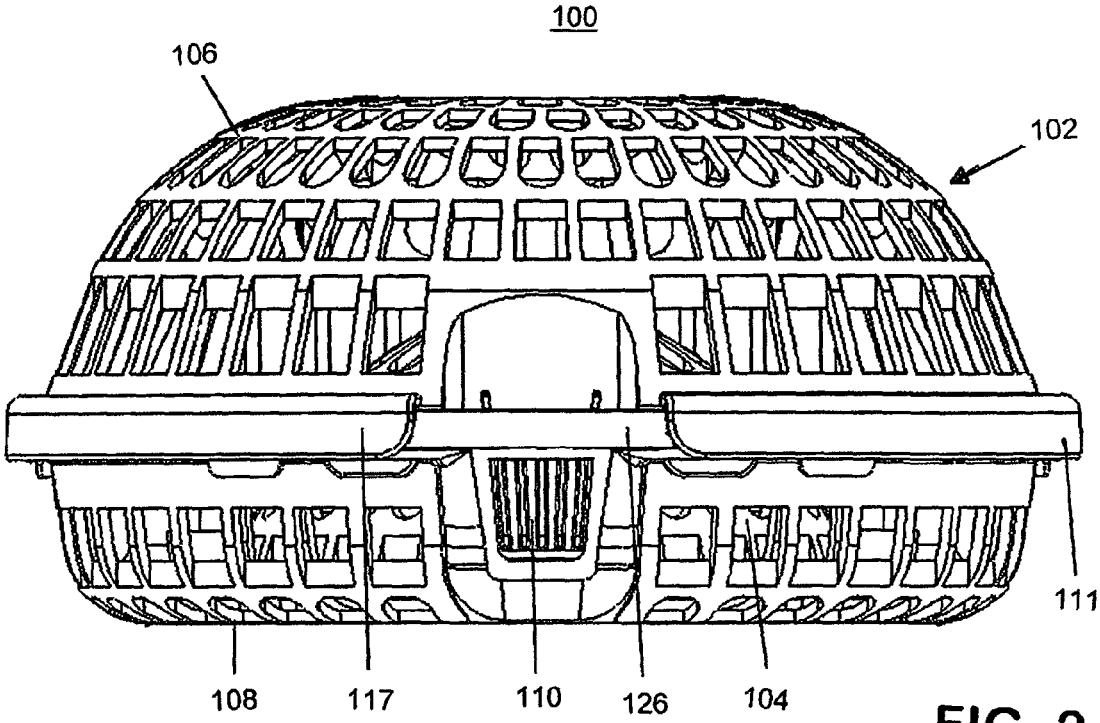
FIG. 2 is a front elevational view of the washing device of FIG. 1 in accordance with the present invention.
Figure 3:
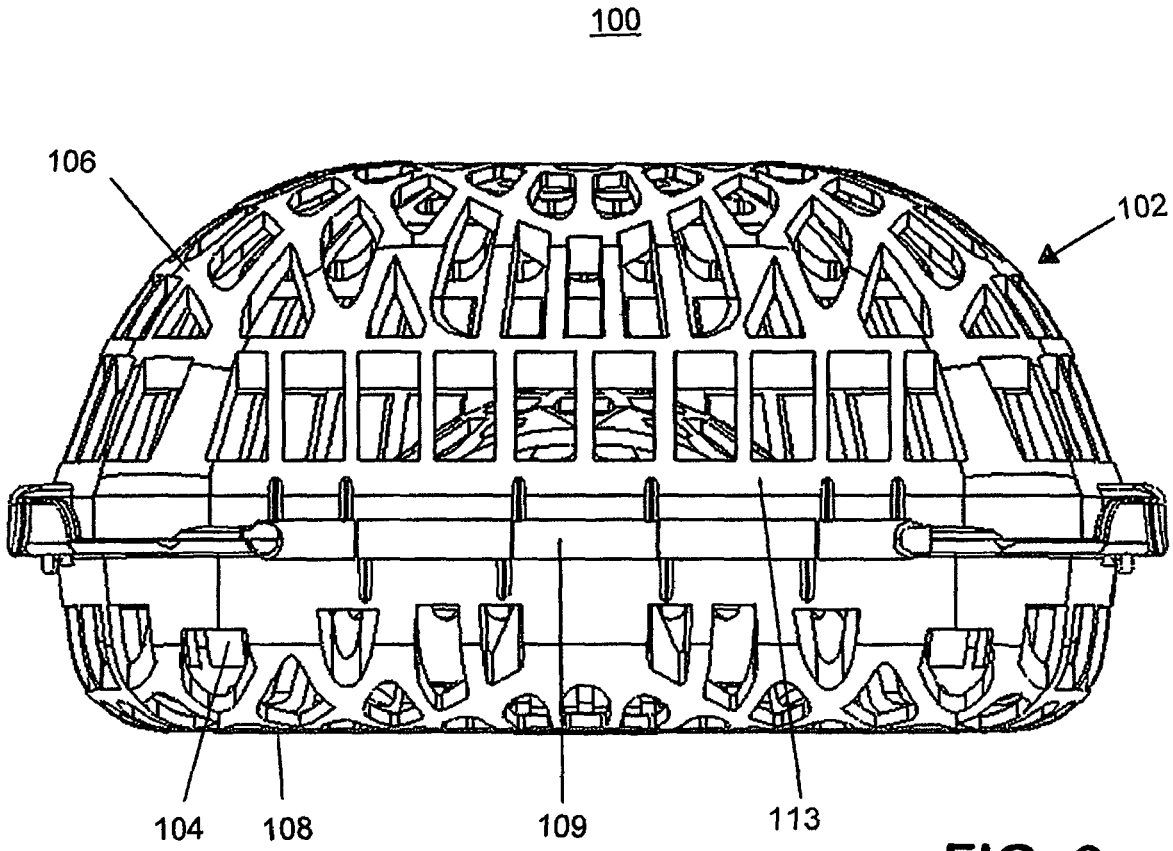
FIG. 3 is a rear elevational view of the washing device of FIGS. 1 and 2 in accordance with the present invention.

FIGS. 1-5 illustrate a washing device, generally designated 100, according to one embodiment. Washing device 100 includes shell 102 and an insert 104. Shell 102 includes upper shell portion 106 and lower shell portion 108. Upper shell portion 106 and lower shell portion 108 may be pivotally connected at a hinge 109. Shell 102 may be opened by swinging upper shell portion 106 away from lower shell portion 108. Insert 104 may be removed from shell 102 when shell 102 is open. Shell 102 includes a latch mechanism 110 (FIG. 2). Latch mechanism 110 may hold shell 102 in a closed position and it may be opened to place a bra or other garment therein, or to add or remove the insert 104.

Washing device 100 may protect a garment from damage caused by the washer, dryer, or other clothing articles. Device 100 may also protect bra under-wires from becoming bent or protruding from the bra and thus piercing its fabric. In one embodiment, shell 102 and insert 104 are made out of polypropylene that is heat graded to protect it from heat damage.

Figure 6:
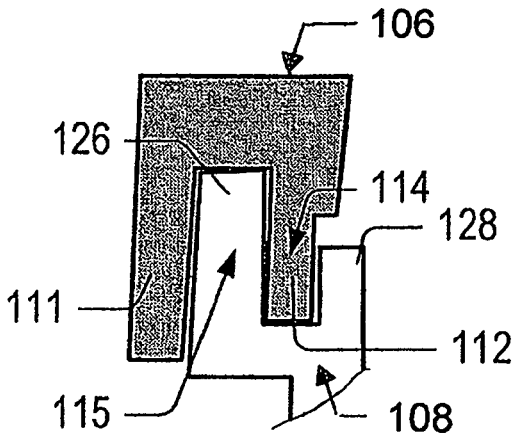
FIG. 6 is a cross-sectional view of the engaging rims and channels of the upper and lower shells of the washing device shown in FIGS. 1-5 in accordance with the present invention.

As shown in FIG. 6, shell upper portion 106 includes channel 115 between outer rim 111 and inner rim 112. Shell lower portion 108 includes channel 114 between inner rim 128 and outer rim 126. Inner rim 112 of upper shell portion 106 may nestle in channel 114 of lower shell portion 108 when shell 102 is closed. Outer rim 126 of lower shell portion 108 may nestle in channel 116 of upper shell portion 106 when shell 102 is closed. Engagement of inner rim 112 in channel 114 and/or rim 126 in channel 115 preferably inhibits lateral movement of upper shell portion 106 relative to lower shell portion 108. Engagement of inner rim 112 in channel 114 and/or outer rim 126 in channel 115 may also inhibit deformation of the shell halves (e.g., flexure, buckling) near the junction of the upper shell portion and the lower shell portion. Inhibiting deformation may keep upper shell portion 106 and lower shell portion 108 from separating when external loads are encountered during washing and/or handling of device 100. Engagement of inner rim 112 in channel 114 and/or outer rim 126 in channel 115 may also alleviate stress on latch mechanism 110 and hinge 109.

In accordance with one aspect of the present invention, a top surface 107 of the upper shell portion 106 and the bottom surface 105 of the lower shell portion 108 are are curved inwardly toward an internal center of the washing device. For example, the top surface 107 of the upper shell portion 106 and the bottom surface 105 of the lower shell portion 108 may be approximately flat. Thus, the washing device 100 is reduced in height, as compared to a sphere of approximately the same diameter. As seen in FIG. 1, a back or rear surface 113, which accommodates hinge 109 is relatively flat. A left side surface 115, a right side surface 116 and a front surface 117 are generally curved or semicircular in configuration. For example, a washing device 100 suitable for washing plus size bras may have the following approximate dimensions: height (bottom surface 105 to top surface 107)=4.25 inches (10.8 cm.), lateral (right side surface 116 to left side surface 117) =8.75 inches (22.2 cm.), and front to back (front surface 115 to back surface 113)=7 inches (17.8 cm.). Thus, even though washing device 100 accommodates plus size bras, with the height of about 4.25 inches, washing device 100 can easily be inserted into a top loading washing machine between the top of the agitator and the top edge of the drum. Thus, the washing device 100 is reduced in height, as compared to a sphere of approximately 8.75 inches diameter, by approximately 4.5 inches (11.4 cm.).

Figure 4:
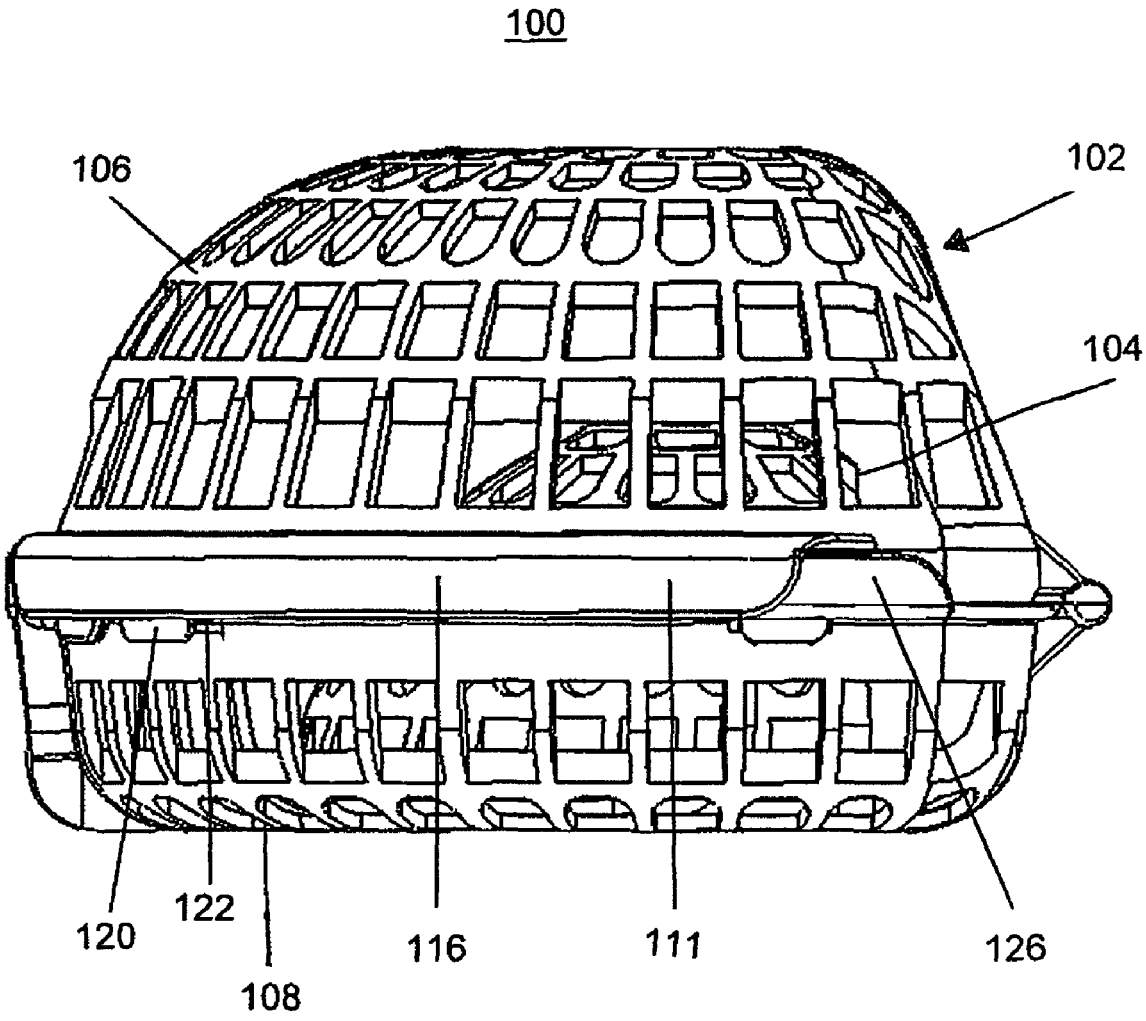
FIG. 4 is a side elevational view of the washing device of FIGS. 1-3 in accordance with the present invention.
Figure 5:
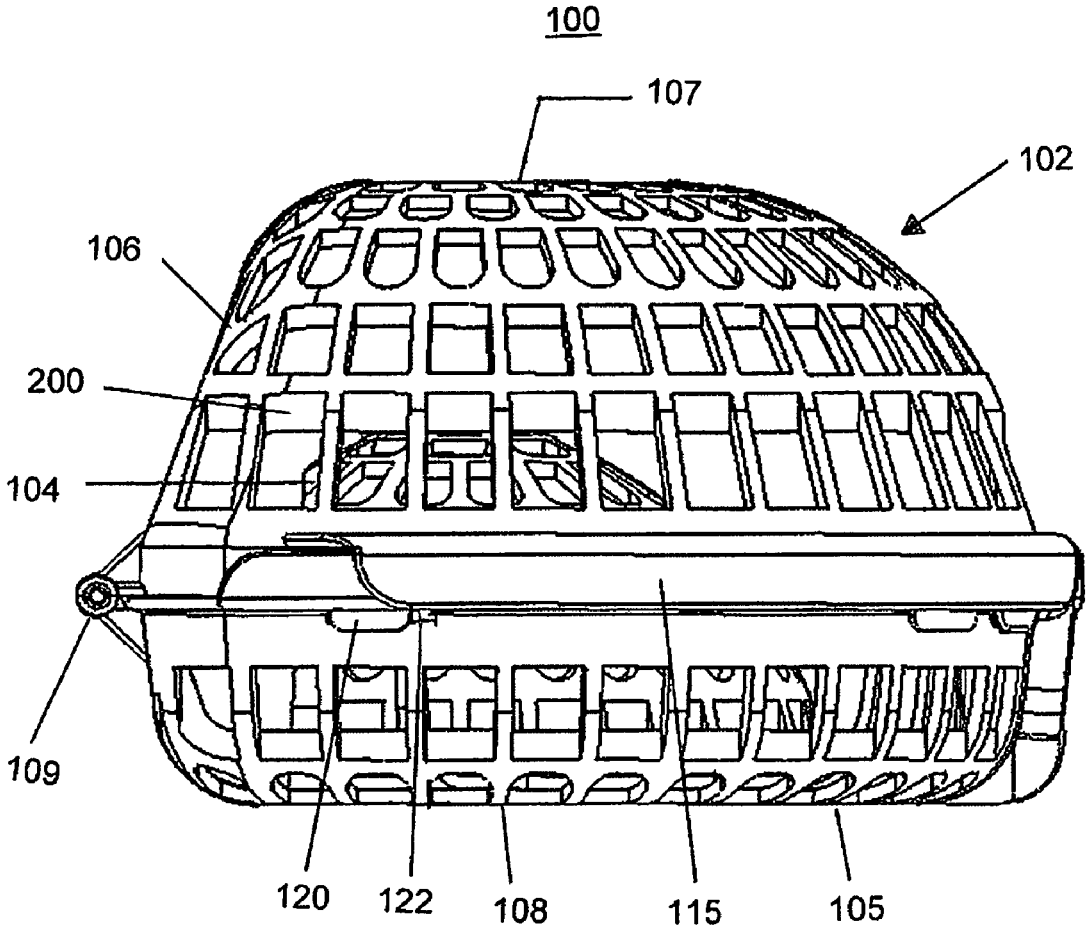
FIG. 5 is a side elevational view of the washing device taken from the opposite side to that shown in FIG. 4.

Referring to FIGS. 4 and 5, insert 104 includes tabs 120. Lower shell portion 108 includes slots 122 disposed in the bottom of channel 114 (FIG. 6). Insert 104 may be coupled with lower shell portion 108 by inserting each of tabs 120 on insert 104 into a corresponding slot 122 on lower shell portion 108. Tabs 120 of insert 104 and slots 122 of lower shell portion 108 may be distributed at various points along the circumference of lower shell portion 108. At least one tab on an insert may be partially or fully opposed to one or more other tabs on the insert.

Figure 7A:
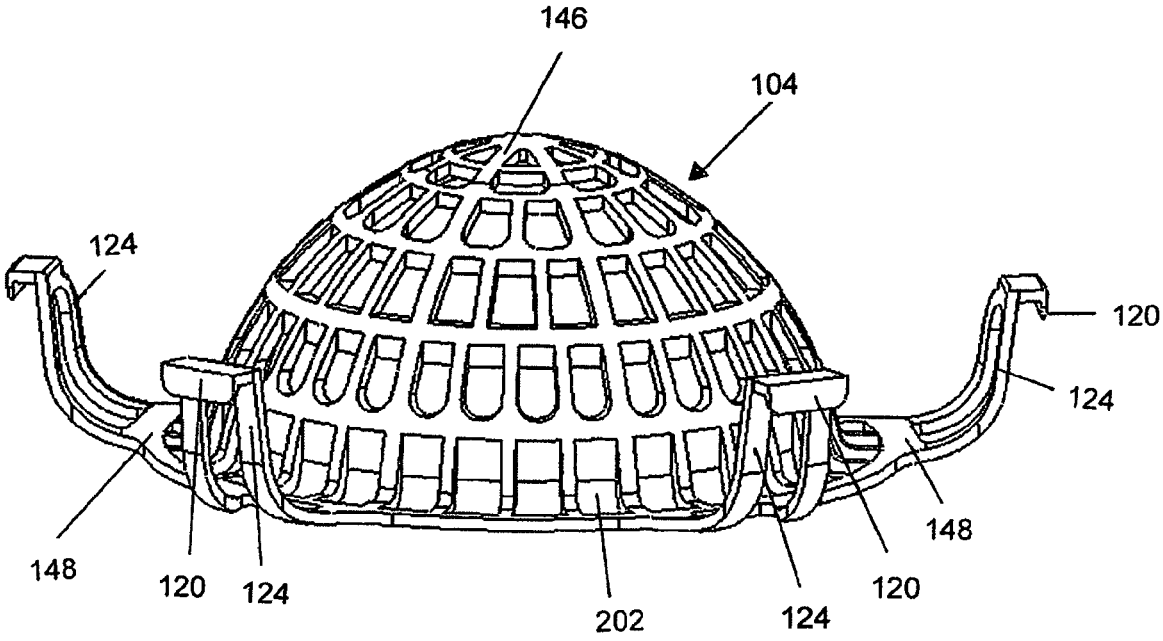
FIGS. 7A and 7B are perspective views of a removable insert which is contained within the washing device shown in FIGS. 1-5 during washing of a garment in accordance with the present invention.
Figure 7B:
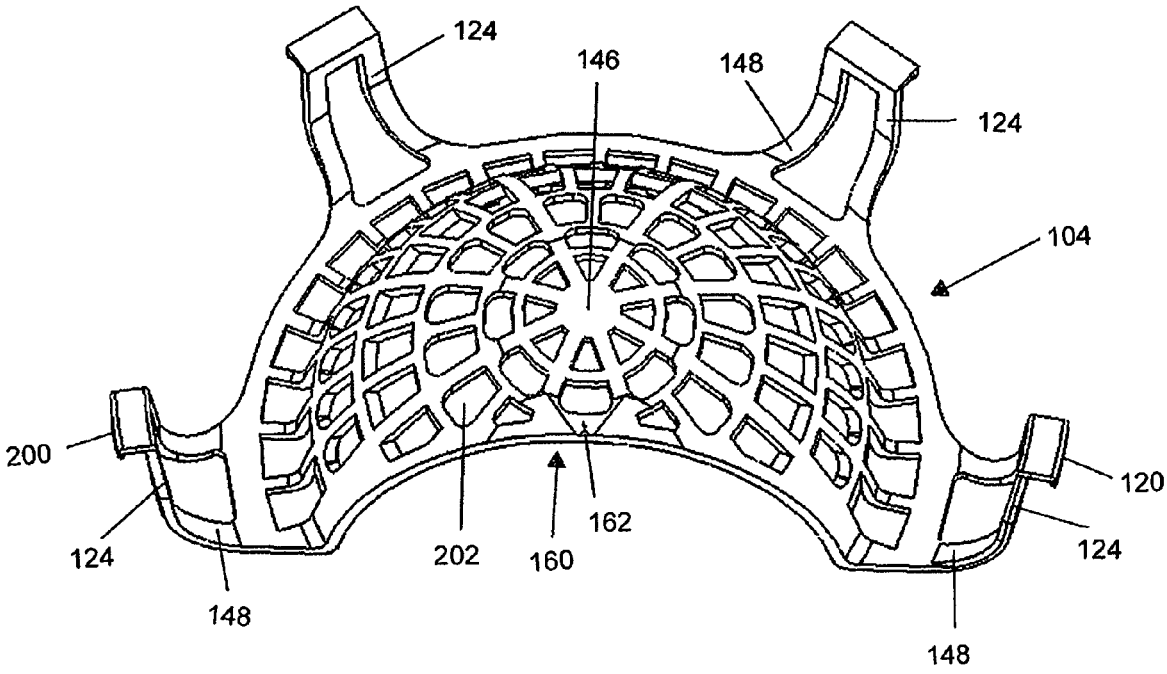

FIGS. 7A and 7B illustrate insert 104 when separated from shell 102. Insert 104 includes a plurality of arms 124. Each arm 124 preferably includes tab 120 at its unattached end. Tab 120 may be inserted into slot 122 on lower shell portion 108. When shell 102 is closed, inner rim 112 of upper shell portion 106 (shown in FIG. 6) may hold one end of arm 124 in place on lower shell portion 106. Thus, closure of shell 102 keeps insert 104 in a relatively fixed position relative to shell 102.

Arms 124 of insert 104 may be integrally connected to a contoured surface, such as to a dome or rounded portion 146 suitable for holding a cup of a bra. Rounded portion 146 may have a contour similar to the inner sides of the breast cup sides they are to be used with, which helps preserve the curvature of under-wires and bra cups during a washing cycle. Arms 124 may have a curved portion 148 (e.g., concave) where the arms attach to the rounded portion 146 to allow for space to accommodate the padding of a padded bra cup.

When installed in shell 102, insert 104 may serve to divide internal volume of shell 102 into two portions, which generally includes the volume above the rounded portion 146 and the volume below or underneath the rounded portion 146. The volume underneath the rounded portion 146 may be referred to as a pocket 160. Pocket 160 includes an access or opening 162. Pocket 160 may house one or more bra straps (e.g., when a bra cup of the bra is placed on the rounded portion 146). Pocket 160 can also house delicate accessories, such as removable bra straps, demi-pads, pushup pads, shoulder pads, hosiery, panties, and scarves.

In one embodiment, shell 102 has sufficient space to accommodate, for example, one thickly-padded bra, or two stacked semi-padded bras, or three stacked non-padded bras. When more than one bra is placed inside shell 102, they may be stacked so that the front sides of the cups of the second bra faces the breast sides of the cups of the first bra, etc.

In an embodiment, a system for washing garments includes a shell and one or more inserts. Each insert may be interchangeably installed in the shell. The inserts may have different shapes. Each of the shapes may accommodate a different type or shape of garment. For example, one insert may have a form suitable for washing a padded bra and another insert may have a form suitable for washing unpadded bras. A user of the device may select the appropriate insert or inserts for the garment or garments the user desires to wash, dry, or store.

Figure 8A:
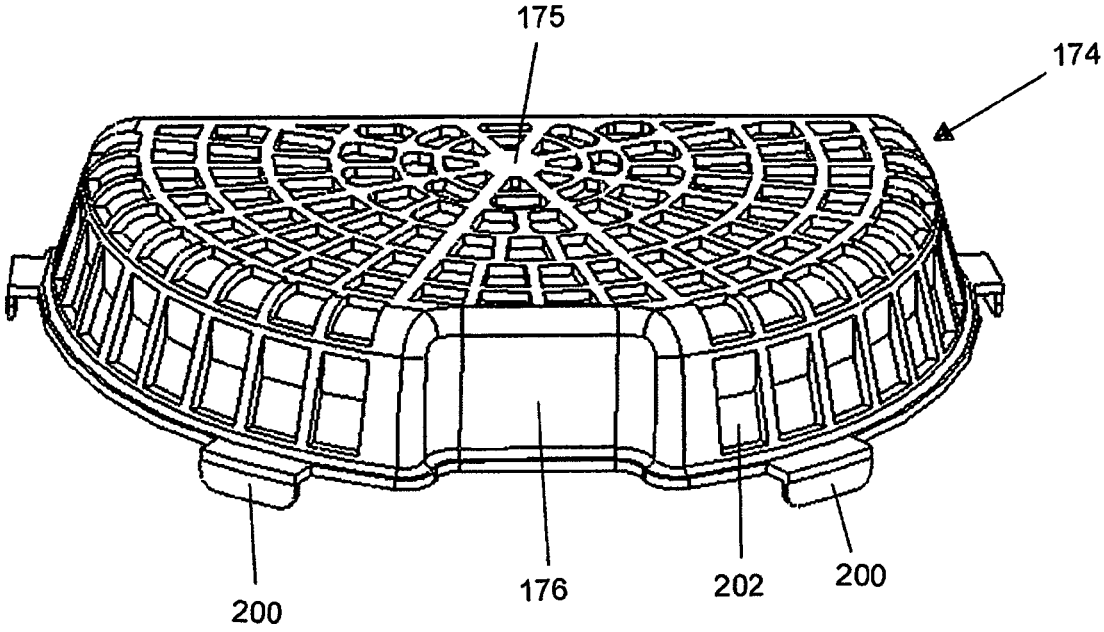
FIGS. 8A and 8B are perspective views of an alternate removable insert which is contained within the washing device shown in FIGS. 1-5 during washing of a garment in accordance with the present invention.
Figure 8B:
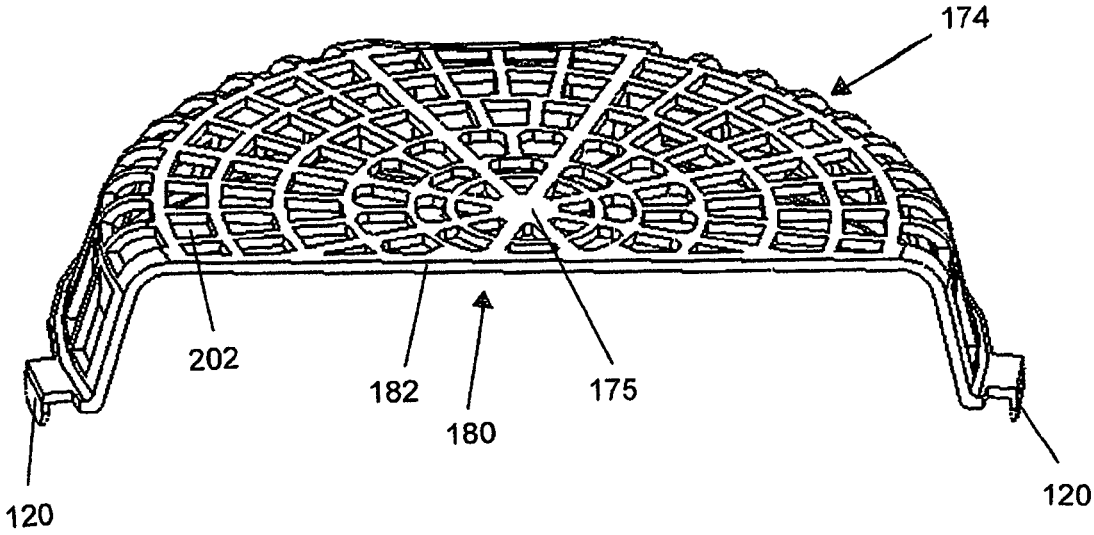

In some embodiments, a washing device 100 may include a form suitable for washing a garment that holds one or prosthetic devices (e.g., a post-mastectomy bra). FIGS. 8A and 8B illustrate an insert 174 for a washing device 100 which may be used for a bra having a prosthetic device. In this embodiment, insert 174 may include a flat surface 175 rather than a rounded portion 146 of insert 104. Such a relatively flat surface may accommodate a bra cup which carries a breast prosthesis. Forms for carrying a prosthesis may also be a convex, concave, or other suitable shape. In one embodiment, a form for carrying prosthesis is customized for the garment. When insert 174 is installed within washing device 100, the volume underneath surface 175 may be referred to as a pocket 180. Pocket 180 includes an access or opening 182. Additional garments may be placed in pocket 180 for washing. Washing devices (e.g., device 100 with insert 174) can also be used for washing, drying, or storing removable bra straps, demi-pads, pushup pads, shoulder pads, hosiery, panties, scarves and small clothing articles.

Alternatively, such items may be washed in shell 102 without any insert.

In some embodiments, the opposing sides of an insert may have different shapes For example, an insert may include a rounded surface on one side (e.g., for an unpadded bra cup) and a flat surface on the other side (e.g., for a bra cup with a breast prosthesis).

Because inserts 104 and 174 can each be inserted into a same shell (e.g., shell 102), a common shell can be used for washing different types of bras and other garments. Although only two inserts are shown in FIGS. 7-8, a system may include less than two different inserts or more than two different inserts. Inserts may be provided for garments other than bras. For example, inserts may be provided for items such as hats, gloves, scarves, hosiery, or slippers.

In some embodiments, an insert may be attached to a shell without tabs or slots. An insert may include pins, flanges, arms, or beams that connect to one portion or both portions of a shell. For example, an insert may include a pin or pins that plug into holes in one shell portion. In certain embodiments, an insert, form or divider may be permanently or semi-permanently attached to an outer shell. An inner form connected by a hinge to an outer shell is shown, for example, in U.S. Pat. No. 6,742,683 to Phan.

Inserts 104 and 174, upper shell portion 106 and lower shell portion 108 may be foraminous, e.g., they may have numerous holes. These holes may allow water, detergent, and air to freely penetrate to a bra inside (not shown) for thorough cleaning, drying, and storage. The numerous holes may allow detergent, water, and air to freely and thoroughly penetrate and flow between the bras when a garment or garments (e.g., two semi-padded or three non-padded bras are washed in the device. In one embodiment, the holes are between about 0.5 cm and about 1.0 cm. The holes may be smaller than the brats shoulder straps, which will prevent the straps from falling out through the holes. Small holes may also prevent bra's back straps and shoulder straps from losing elasticity and the hooks on the bra's back strap from catching onto other clothing articles, zippers, buttonholes, the washer and dryer's crevices, as well as the bra itself. In one embodiment, shell 102 has a diameter of about 12 to about 16 cm with each portion having about 60 to 80 holes (depending upon the device's size, which is determined by the bra's cup size). Insert 104 may have about 40 to 70 holes. In some embodiments, a flange, web or other portion of an insert connecting a form may also include openings.

FIGS. 5, 7A-7B and 8A-8B illustrate a washing device 100 and two inserts 104, 174 therefor. Upper shell portion 106 and lower shell portion 108 include shell openings 200. Insert 104 includes insert openings 202. In some embodiments, shell openings 200 are sized and shaped to inhibit the bra strap or portions thereof from extending outside of the shell. Holes may be large enough for water, detergent, and air to penetrate, but small enough to contain bra shoulder strap, back strap, and hooks, thus preventing them from becoming tangled with other clothing articles and the washer and/or dryer's crevices. Insert openings 202 may be larger than shell openings 200. Relatively large insert openings 202 may allow for better flow through the insert, thereby increasing cleaning effectiveness.

Figure 9:
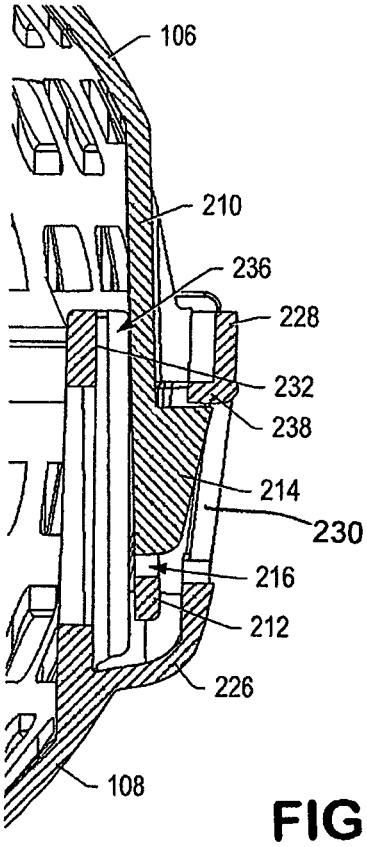
FIG. 9 is a cross-sectional view of the latching mechanism for the washing device shown in FIG. 2 in accordance with the present invention.
Figure 10:
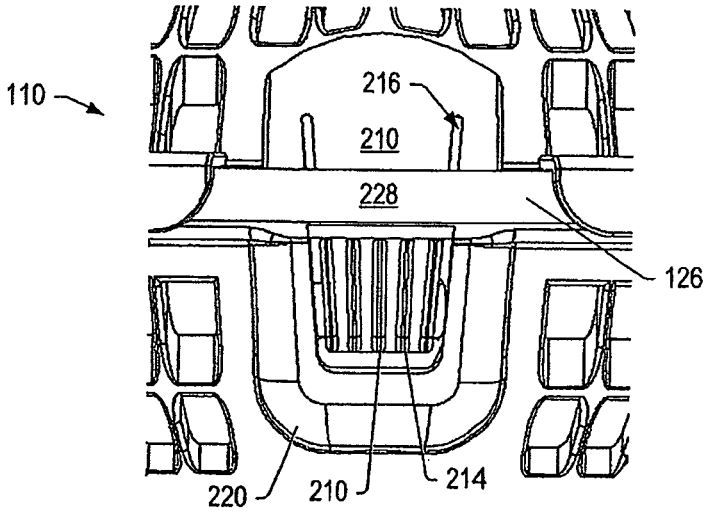
FIG. 10 is an enlarged elevational view of the latching mechanism for the washing device shown in FIG. 2 in accordance with the present invention.

FIGS. 9 and 10 illustrate latch mechanism 110 for the washing device 100. FIG. 9 illustrates a cross-sectional view of latch 110 in a latched position, and FIG. 10 is an enlarged elevational view of the latch 110. Referring to FIG. 9, upper shell portion 106 includes tongue 210 and loop 212. Tongue 210 includes latch projections 214. Tongue 210 may resiliently deflect when a load is applied to latch projections 214 toward the interior of upper shell portion 106. U-shaped slot 216 may extend through the entire thickness of upper shell portion 106, thereby creating a U-shaped gap between tongue 210 and loop 212.

Referring to FIG. 10, lower shell portion 108 includes receptacle 220. Receptacle 220 includes a catch 228. Raised front wall surface 226 and catch 228 may shield tongue 210 from normal wear and tear. In addition, having tongue 210 recessed may help keep device 100 from being accidentally opening during washing, drying, and storage.

During operation of latch mechanism 110, tongue 210 and loop 212 are received in receptacle 220. Latch projections 214 slide over catch tab 238. The distal portion of tongue 210 deflects inwardly as tongue 210 and loop 212 advance into receptacle 220. When latch projections 214 slide beyond catch tab 238, tongue 210 may spring back outwardly such that latch projections 214 extend into finger opening 230. Tongue 210 may snap into a latched position. Contact between latch projections 214 and catch 228 inhibit shell 102 from opening.

To open shell 102, a user may engage the upper edge of outer rim 226 with one or more fingers and depress tongue 210 with the thumb of the same hand. The user may push inwardly on latch projections 214 of tongue 210 through finger opening 230 until tongue 210 bottoms out on back wall 232. When tongue 210 bottoms out on back wall 232, a portion of latch projections 214 (e.g., tips 239) may come just short of clearing catch tab 238. The user may exert an upward force on tongue 210 so as to overcome the resistance of latch projections 214 against catch tab 238 and force latch projections 214 upward past catch tab 238. The inner end of catch tab 238 and/or back wall 232 may deflect at least slightly under the upward force of latch projections 214 so as to allow latch projections 214 to pass catch tab 238. Thus, a user releases latch mechanism 110 by simultaneously applying force in two directions (e.g., a force inward on tongue 210 against the resilient force of the tongue, and a force upward on tongue 210 against the resistance of catch tab 238). A latch mechanism that opens by the application of a force in two directions may be less prone to accidental opening during use in a washing machine. For example, in the embodiment described above, even if latch projections 214 directly strike a pointed surface (e.g., part of the agitator of the washing machine) when the device is agitated within the washing machine (thereby applying an inward force to tongue 210), latch mechanism 110 may remain latched because there is no upward force to impel latch projections 214 over catch tab 238.

As noted above with respect to FIG. 11, interior portion 224 of receptacle 220 includes rails 236. Loop 212 on upper shell portion 106 may contact rails 236 when tongue 210 and loop 212 are inserted into receptacle 220. Contact between loop 212 and rails 236 may inhibit the upper portion of tongue 210 from deflecting inwardly. In some embodiments, contact between loop 212 and rails 236 may inhibit latch mechanism 110 from opening accidentally during washing.

In certain embodiments, a tongue may be relatively short such that a relatively large force is required to deflect the end of the tongue.

In view of the foregoing, it will be appreciated that multiple bras can be thoroughly cleaned, dried, and stored in a single wash cycle. When two semi-padded or three non-padded bras are simultaneously washed in the device, holes may allow detergent, water, and air to freely penetrate and flow between the bras to thoroughly wash and dry as well as safely store each bra, including a middle placed bra when three bras are concurrently washed.

As used herein, "shell" includes any element that at least partially encloses, houses, or covers one or more other objects. Examples of such objects include garments, forms, inserts, and accessories. A shell can have one part or more than one part. For example, a shell may have two halves or two portions which are connected by a hinge. A shell may have closed or open surfaces (e.g., surfaces having openings).

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. Terms relating to orientation such as "upper", "lower", "top", "bottom", "left", or "right" are used for reference only; the device herein may be used in any orientation.

While particular embodiments of the invention have been shown and described, it will be obvious to those skilled in the art that changes and modifications may be made therein without departing from the invention in its broader aspects.

The invention claimed is:

1. A washing device for washing plus size bras, comprising:

a shell with an interior;

the shell consisting of an upper shell portion and a lower shell portion, said upper shell portion and said lower shell portion having inwardly curved upper and lower surfaces, respectively, such that the height of the shell is less than the lateral dimension of the shell between opposite sides;

one of the shell portions having a rim which comprises a channel;

the other shell portion having a rim which comprises a lip;

the lip on the rim of one of the shell portions couples into the channel on the rim of the other shell portion when the shell is closed;

a removable insert is coupled to the shell in a tab and slot arrangement, such that the insert is kept in a substantially fixed relationship to the shell, such that the insert resides wholly within the shell, and such that the insert may be removed;

a hinge disposed along one side of the upper shell portion and the lower shell portion, said hinge permitting opening of the upper shell portion with respect to the lower shell portion to insert a bra into the interior of the washing device; and a releasable latch mechanism to securely hold the upper shell portion and the lower shell portion together during a washing cycle.

2. The washing device of claim 1 wherein the inwardly curved upper and lower surfaces of the upper and lower shell portions are inwardly curved toward an internal center of the washing device.

3. The washing device of claim 1 wherein the inwardly curved upper and lower surfaces of the upper and lower shell portions each have a portion which is relatively flat.

4. The washing device of claim 1, wherein the insert comprises a rounded portion to generally conform to the shape of a bra cup.

5. The washing device of claim 4, wherein the insert further comprises a plurality of arms extending between the tabs and the rounded portion.

6. The washing device of claim 4, wherein at least a portion of the insert is substantially spherical.

7. The washing device of claim 1, wherein at least a portion of the insert is substantially flat.

8. The washing device of claim 1, wherein the insert comprises a pocket configured to receive at least one bra strap.

9. The washing device of claim 1, wherein the insert is configured to divide the interior of the shell into two spatial regions, and a passage connects the two spatial regions.

10. The washing device of claim 1, wherein the shell includes a generally flat rear surface and generally curved side and front surfaces.

11. The washing device of claim 1, wherein the latch mechanism comprises:

a tongue and a loop on one portion of the shell; and a receptacle on the other portion of the shell, the receptacle configured to receive the tongue and the loop.

12. The washing device of claim 11, wherein the receptacle comprises a rail configured to contact the loop, and wherein contact between the loop and rail inhibits the latch mechanism from opening accidentally during washing.

13. The washing device of claim 12, wherein the latch mechanism comprises a resilient member on one shell portion, wherein the resilient member is between a pair of slots, wherein the slots do not overlap with the other shell portion when the latch mechanism is closed.

14. The washing device of claim 11, wherein the latch mechanism is operated by simultaneously applying a force in an inward direction and a force toward the plane or division between the upper and lower shell portions.

15. The washing device of claim 1, said shell including a plurality of openings, the openings being sized to inhibit a bra strap from extending out of the shell through the openings.

16. The washing device of claim 1, said insert including a plurality of openings.

17. The washing device of claim 16, said insert including a plurality of openings, wherein at least one of the openings in the insert are larger than the openings in the shell.

18. The washing device of claim 1, wherein said height of the washing device is about one-half of the lateral dimension of the washing device.

* * * * *